US005677958A

United States Patent [19]

Lehringer

[11] Patent Number: 5,677,958

[45] Date of Patent: Oct. 14, 1997

[54] ACTIVE SOUND DAMPER

[75] Inventor: Frank Juergen Lehringer, Wernsdorf, Germany

[73] Assignee: Leistritz AG & Co Abgastechnik, Fuerth-Stadeln, Germany

[21] Appl. No.: 581,600

[22] PCT Filed: Jun. 23, 1994

[86] PCT No.: PCT/DE94/00723

§ 371 Date: Jan. 5, 1996

§ 102(e) Date: Jan. 5, 1996

[87] PCT Pub. No.: WO95/02238

PCT Pub. Date: Jan. 19, 1995

[30] Foreign Application Priority Data

Jul. 7, 1993 [DE] Germany ..... 43 22 627.2

[51] Int. Cl.[6] ..... G10K 11/16

[52] U.S. Cl. ..... 381/71; 181/206

[58] Field of Search ..... 381/71, 154, 188, 381/205; 181/206, 224, 227, 228

[56] References Cited

U.S. PATENT DOCUMENTS

| | | | |
|---|---|---|---|
| 3,936,606 | 2/1976 | Wanke . | |
| 4,665,549 | 5/1987 | Eriksson et al. . | |
| 5,097,923 | 3/1992 | Ziegler et al. . | |
| 5,257,316 | 10/1993 | Takeyama et al. | 381/71 |

FOREIGN PATENT DOCUMENTS

| | | |
|---|---|---|
| 0542761 | 5/1985 | Australia . |
| 0227372 | 7/1987 | European Pat. Off. . |
| 0592693 | 4/1994 | European Pat. Off. . |
| 89/07701 | 8/1989 | WIPO . |
| 91/15666 | 10/1991 | WIPO . |

OTHER PUBLICATIONS

F. Hausdorf: "Handbuch der Lautsprechertechnik" [Handbook of Speaker Technology]. vol. 3, 1990, Copyright Visation, pp. 21–29.

*Primary Examiner*—Forester W. Isen
*Attorney, Agent, or Firm*—Spencer & Frank

[57] ABSTRACT

An active sound damper for compensating interference noise radiated by an interference noise source through a radiation opening of the interference source. The radiation opening of the interference noise source defines a radiation plane and has a center. The sound damper includes a speaker for radiating compensation sound for reciprocally effecting one of a weakening and a cancelling of the interference noise by interfering with the interference noise, the speaker having a speaker cone and defining a longitudinal axis. The speaker is further adapted to be mounted on the radiation opening such that its longitudinal axis is disposed to transversely intersect the radiation plane at the center of the radiation opening and such that the speaker cone radially surrounds the radiation opening.

33 Claims, 5 Drawing Sheets

ACTIVE SOUND DAMPER

FIELD OF THE INVENTION

The invention relates to an active sound damper for compensating interference noise radiated by an interference noise source.

BACKGROUND OF THE INVENTION

Sound dampers of the above kind are used in sound damping systems and reduce the sound level of a sound field, experienced as annoying. The overall sound damping system in principle has a sound damper as well as a sensor for providing information about the interference noise to be expected and/or a control sensor for receiving the already damped or canceled-out interference noise. The sensor signal corresponding to the noise level is supplied to a control unit for further processing. The processed sensor signal thereafter reaches a speaker in the form of an electrical signal. The speaker is a component of the sound damper and radiates compensation sound or (anti-sound). The electrical signal supplied to the speaker is calculated so that the two sound fields corresponding to the compensation sound and the interference noise overlap in antiphase according to the principle of interference known from physics. As a result, the interference noise is cancelled out or at least considerably reduced.

WO 91/15666 and U.S. Pat. No. 5,097,923 disclose active noise dampers for reducing exhaust noise in motor vehicles which have one or a plurality of speakers. Each speaker is disposed in a compensation sound chamber. Compensation sound chambers are disposed diametrically opposite one another on the pipe jacket of the exhaust pipe so that the radiation direction of the speaker runs radially to the exhaust pipe. Due to the lateral disposition of the speakers, the compensation sound waves must travel a certain distance to the pipe opening, which constitutes the radiation opening of the noise, in order to generate a homogeneous compensation sound field at that location. To this end, the compensation sound field generated in the sound chamber is supplied to the exhaust opening via a conduit disposed concentrically around the exhaust pipe. As a result, the sound damper takes up a great deal of space and has a structurally complex design. Due to the complex outer contour of the sound dampers of the prior art, their manufacture is difficult from a technical manufacturing viewpoint, and can consequently be very cost intensive.

Moreover, since installation conditions according to the prior art are often very cramped, and since the sound damper should therefore take up as little installation space as possible, a further volume enlargement of the sound damper, which already takes up a great deal of space, is possible, if at all, only in a limited manner. However, it is desirable to provide as large as possible a chamber particularly at the back end of the speaker in order to produce low-frequency tuning of the speaker. Therefore since, as pointed out above, it is impractical to provide more space for sound dampers of the prior art the efficiency of the speaker in prior art sound dampers is low. Furthermore, the exact coupling between the control sensor and the speaker is impeded due to the large transmission path between the speaker and the radiation opening of the exhaust pipe. The damping of interference noise according to the prior art is therefore insufficient.

An active sound damping system is known from EP-A-227 372, in which the radiation directions of interference noise and compensation sound are aligned approximately parallel to one another. However, the particular disposition of the speaker which generates the compensation sound requires a sound damper, which is structurally very complex and takes up a great deal of space, in order to be able to damp the noise.

The object of the invention is to embody a sound damper of the above mentioned kind in a space saving manner, and to produce an antiphase overlapping of interference noise and compensation sound in a geometrically simple manner.

SUMMARY OF THE INVENTION

The above object is attained by the invention, according to which, the speaker cone radially surrounds the radiation opening. As a result, the radiation directions of the compensation sound and the interference noise are aligned parallel to each other from the start and the acoustic centers of both sound fields are disposed on a common axis. Thus, according to the invention, transmission paths are completely unnecessary for the generation of a homogeneous compensation sound field for overlapping with the noise field. In this manner, an advantageous overlapping of noise and compensation sound is possible in a geometrically simple manner. Consequently, the sound damper is considerably simplified structurally. Due to the omitted transmission paths and the concentric disposition of the speaker, the sound damper is designed in a space-saving manner. The space thus saved can be used as the rear chamber of the speaker for the low-frequency tuning therefore. As a result, the sound damper according to the invention can be used even if space conditions are cramped.

The omitted transmission path between speaker and radiation opening makes possible a simplified transmitting function, and, consequently, a more precise coupling between the speaker and a control sensor which receives the damped interference noise. Since transmission delays are considerably reduced with the coupling, the speaker reacts rapidly and precisely to the changing interference noise level. The coupling, for example by means of a control unit, can as a result be realized by technically simpler means. The sound damper is by and large less costly to manufacture while at the same time having an increased efficiency.

Due to the short path difference between the speaker and the radiation opening, annoying resonances are produced only at high frequencies, which are not a concern in the use of the sound damper. As a result, the operation of the sound damper is more uniform over the entire relevant frequency range.

Normally, the speaker cone is embodied rotationally symmetrically with respect to the longitudinal axis of the speaker. It therefore has a circular cross section. Diverging from the above, the speaker cone can also have an elliptical cross sectional shape for example. Additionally, since the wavelengths applicable in the use of the sound damper are long relative the lateral dimensions of the speaker, a smooth compensation sound field is produced. With different cross sectional shapes of the speaker cone, the sound damper can be adapted even better to different space conditions.

Even a large speaker cone saves space due to the compact disposition of the speaker around the radiation opening. Therefore, the cone area can be selected to be large in many instances of use of the sound damper. In this manner, the large volume flow which is required for high compensation sound levels is produced by means of smaller oscillation amplitudes of the speaker cone. As a result, while the compensation effect of the speaker remains the same, the mechanical load on the speaker cone is further reduced. Therefore, the reliable operating method of the speaker is assured over an even larger period of time.

Different drive principles and structures of the speaker cone can be chosen for the speaker to be used.

According to one embodiment of the invention, the speaker operates according to the known electrodynamic drive principle. Electrodynamic speakers more than adequately meet the demand for quicker adjustability and adaptation to changing noise levels.

A speaker known for example from F. Hausdorf, Handbuch der Lautsprechertechnik (Handbook of Speaker Technology), Vol. 3, 1990, Copyright VISATON, p. 21 et seq., in a simple manner, has a conical construction which makes possible its disposition approximately concentric to the center of the radiation opening which radiates the interference noise.

According to another embodiment of the invention, the speaker cone and the radiation opening end approximately flush in the axial direction of the speaker. As a result, it is assured that the total compensation sound field generated by the speaker cone is used to cancel out the noise field. The speaker cone is configured as a funnel or as a flat cone for example.

According to yet another embodiment of the invention, the radiation opening is the pipe opening of a sound pipe. Therefore the sound damper according to the invention can also be used in internal combustion engines.

According to a further embodiment of the invention, the magnetic system, which is in general commonly known in connection with electrodynamic speakers, includes a central bore extending in the direction of the longitudinal axis of the speaker so that the sound pipe can pass through this bore. In the above manner, the sound pipe is used not only for guiding the interference noise, but also as a mechanical aid for fixing the speaker, and consequently also the entire sound damper, in place. The concentric disposition of the speaker around the sound pipe therefore makes it possible to install the sound damper in a manner which is simple from a technical assembly viewpoint. In addition, the number of fastening means required for a mechanically firm seating of the speaker can be reduced.

It should be mentioned that the ring magnet radially surrounds the pierced pole core in a known manner to form the magnetic system. Therefore, the ring magnet does not need to be additionally mechanically processed to radially surround the sound pipe. It is also possible, however, to interchange the pole core and the ring magnet. In this case, a ring-shaped pole core surrounds a pierced magnet core.

According to another embodiment of the invention, a radial spacing may be provided between the speaker and the sound pipe, which spacing acts as a closed intermediate space. The intermediate space is closed so that acoustic short circuits are prevented between the front and the back of the speaker. The radial spacing has the advantage that the speaker, in particular the magnetic system and the sensitive speaker cone, are not directly exposed to the effects of the sound pipe. This is important for example if the sound pipe is equipped as an exhaust pipe, which carries hot exhaust gases.

According to yet another embodiment of the invention, a heat insulation layer is provided for thermal insulation between the speaker and the sound pipe. With an appropriate layer thickness, the insulation layer can be disposed clamped between the sound pipe and the magnetic system so that no further fastening means are necessary for fastening the insulation layer on the pipe jacket of the sound pipe. It is furthermore advantageous if, in addition to the pipe jacket section in the region of the magnetic system, the insulation layer also covers the pipe jacket sections in the region of the speaker cone and in the region of the speaker back. As a result, the insulation layer produces a thermal insulation between the speaker and the entire sound pipe. The thermal insulation produces an action of the magnetic system which is independent of temperature fluctuations of the sound pipe so that the reliable operation of the speaker is assured.

According to a further embodiment of the invention, an intermediate pipe as an alternative insulating element. The intermediate pipe surrounds the sound pipe at a radial distance therefrom. The intermediate pipe functions as a cooling body and can absorb a large part of the heat radiated by the sound pipe.

According to a further measure for thermally insulating the speaker with respect to the sound pipe an insulating layer is provided, at least in the region of the magnetic system, in a pipe conduit defined between the intermediate pipe and the sound pipe.

According to a further possibility for thermally insulating the speaker or cooling the same, the coolant flowing through the pipe conduit between the sound pipe and the intermediate pipe can for example be air or a fluid.

According to one embodiment of the invention, the pipe conduit is closed in the axial direction at the front of the cone. As a result, it is assured that when the compensation sound field is formed, no additional bypass is produced, which could impede the required overlapping of the compensation sound field with the interference noise field. In addition, the closing produces a seal of the pipe conduit with regard to the front of the cone. As a result, an inadvertent escape of coolant at the front of the cone is reliably prevented.

According to another embodiment of the invention, the insulation layer has a double function as an insulation element between the speaker and the sound pipe and as a closing element for sealing the pipe conduit with regard to the front of the cone.

According to yet another embodiment of the invention, the intermediate pipe, which concentrically surrounds the sound pipe, has a further function. It is embodied structurally as a bass reflex tube. Bass reflex tubes are known from HiFi technology. In addition to having improved thermal insulation capabilities, an intermediary pipe of this kind considerably improves the efficiency of the speaker device in the low frequency range.

According to a further embodiment of the invention, cooling of the magnetic system of the speaker is provided. In order to effect the above, either the pole core, which radially surrounds the sound pipe, or in the case of the above-mentioned interchange of the pole core and the ring magnet, the magnet core, is pierced. A coolant, for example air or a fluid, flows through the central bore of the magnetic system. In order to be able to supply the cooling means to the magnetic system in the fashion of a circuit, and to withdraw the cooling means therefrom, the bore is connected to a hose line, for example. In an advantageous manner, the bores may be evenly distributed in the circumferential direction of the pole core or magnet core in order to effect an even cooling of the entire magnetic system. The bores are fluidically connected to one another as a component of a cooling circuit. This connection can be likewise produced for example by means of a hose line.

According to another embodiment of the invention, an acoustic baffle is provided to fulfill a double function. On the one hand, it supports the mechanically firm seating of the speaker inside the sound damper. For the above purpose, speaker is fastened with the frame edge of its speaker frame on the acoustic baffle. On the other hand, the acoustic baffle divides the front of the cone from the back of the cone in the axial direction of the speaker and prevents acoustic short circuits in a known manner.

The provision of a closed speaker housing according to a further embodiment of the invention completely prevents acoustic short circuits, even at the lowest frequencies. The compact arrangement of the speaker also makes possible the choice of a large chamber for the speaker housing on the back of the cone without impairing the space-saving design of the sound damper.

In a further embodiment, the chamber of the speaker housing can also contain the electronics required for the coupling between the sensors and the speaker. In the above case, the electronics are sufficiently electrically insulated and protected against mechanical damage without further technical means. Only one or a plurality of the sensors as well as their feed lines to the electronics are disposed outside the speaker housing as components of the sound damper. As a result, the entire sound damper constitutes a compact unit.

If the radiation opening is the pipe opening of a sound pipe, then, apart from the recess in the acoustic baffle for the insertion of the speaker, the speaker housing also contains a recess for lead-through of the sound pipe the recess providing a positive fit between the speaker housing and the sound pipe.

According to one embodiment of the invention, the sound damper is suited for sound damping in internal combustion engines of any type. The sound damper can also be used in ship building, for example.

According to another embodiment of the invention, the sound pipe is the exhaust pipe of a motor vehicle. The speaker housing is preferably composed of half shells, as is standard with mufflers in motor vehicle construction. In the above case, the outer shape of the half shells, which are made to fit the undercarriage of the vehicle, make possible an additionally enlarged chamber for the speaker housing. The half shell construction allows a manufacture of the speaker housing by means of all welding and folding technologies known from sound damper construction. Since these sound dampers are mass produced, the sound damper according to the invention can also be obtained for a reasonable price. In conventional sound damper construction, the half shells are stabilized by additional support bases. These support bases can be omitted when the conventional sound damper housing is used as the speaker housing. The speaker frame itself advantageously stabilizes the half shells. Therefore, the sound damper is constructed in a mechanically sturdy manner with a very low expenditure for parts. At the same time, the low number of components supports the assembly of the sound damper in an assembly-friendly manner. As a result, the sound damper according to the invention can be used as a reasonably priced sound damper in motor vehicles, the construction of which is considerably improved.

Annoying air resonances or standing waves can develop in the speaker housing. To damp the above the chamber of the speaker housing may be partially or completely with appropriate sound absorbing materials.

According to yet another embodiment of the invention, an acoustically transparent, perforated front attachment pipe may be provided, to better protect the speaker cone from the exhaust gases escaping from the pipe opening of an exhaust pipe. In the above arrangement, the front attachment pipe functions like an exhaust pipe which is elongated in the gas flow direction. Because of the acoustically transparent perforations of the front attachment pipe, the noise is further canceled out directly in front of the radiation opening. The exhaust gases, however, are carried away from the radiation opening in the gas flow direction inside the front attachment pipe. In the above manner, the speaker cone is exposed neither to very high exhaust gas temperatures nor to the harmful chemical compounds of the exhaust gases.

According to a further embodiment of the invention additionally, the speaker is well protected against mechanical damage on its cone front, for example against external pressure or impact forces by being fastened at the frame edge thereof to an acoustically transparent, perforated protective screen. The screen opening for the passage of the radiation opening can also be used as an aid in fixing the assembly of the protective screen in place on the sound damper.

Furthermore, the protective screen may be configured as a plate to take into account the space-saving construction of the sound damper.

In addition, a concentrating pipe disposed coaxially with respect to the radiation opening is effective for concentrating the zone for the overlapping of the noise and the compensating sound into a small volume in front of the radiation opening. The above arrangement ensures that as large as possible a percentage of the noise field is canceled out.

If the speaker is inserted in a speaker housing, the concentrating pipe can also be embodied as a one-piece elongation of the housing wall in the axial direction of the speaker. The concentrating pipe is then simply separated in the axial direction from the rest of the housing by the acoustic baffle and/or the speaker.

For providing a compact outer contour of the sound damper the perforated front attachment pipe and the concentrating pipe may be configured to end approximately flush with one another in the sound carrying direction. The front attachment pipe also protects the concentrating pipe from harmful exhaust gases.

According to one embodiment of the invention, an acoustically transparent, perforated protective screen may be fastened to the locking collar of the concentrating pipe. This protective screen protects the entire inner chamber enclosed by the concentrating pipe, including the speaker cone and, if need be the front attachment pipe, from mechanical damage. A screen opening is not required for the protective screen provided that the sound damper has no front attachment pipe. The protective screen attached to the concentrating pipe, in combination with the protective screen attached to the speaker, protects the speaker even more effectively against damage.

The sensor for receiving the compensated noise may be well protected against mechanical damage or other external influences without additional technical measures. In order to effect the above, at least one sensor for receiving the compensated interference noise is disposed inside the concentrating pipe. The sensor may be disposed at a radial distance with respect to the pipe axis extending in the axial direction of the concentrating pipe. The sensor can be fastened in a simple manner to the inner wall of the concentrating pipe. As a result, in addition to its concentrating function, the concentrating pipe also perform a mechanical protection and support function for the sensor.

Furthermore, a plurality of sensors, which are fastened to the concentrating pipe, can be provided for improved detection of the sound compensation. A sound damper, which is equipped with a plurality of sensors, can even be used if one sensor is defective. As a result, the repair-free service life of the sound damper is further lengthened with high efficiency. A plurality of sensors can be disposed in the circumferential direction of the concentrating pipe, for example with an even circumferential spacing.

The radial spacing of the sensor from the pipe axis of the concentrating pipe may be about 9/10 of the overall distance between the pipe axis and the inner wall of the concentrating pipe. As a result of this particular spacing with regard to the pipe axis, the sensor is insensitive to the first radial resonance of the two overlapped sound fields. A faulty detection of the sound compensation is consequently prevented.

According to one embodiment of the invention, an adapter hood, which functions as a pressure chamber, is mounted on the front of the cone. As a result, a pressure chamber speaker is produced, as is known from F. Hausdorf, Handbook of Speaker Technology, Handbuch der Lautsprechertechnik Vol. 3 1990, Copyright VISATON, p. 28 et seq. The adapter hood and the pipe section considerably improve the adaptation of the speaker cone to the air. Accordingly, the efficiency of the sound damper is increased in a simple manner. In a further function, the adapter hood and the pipe section protect the speaker and the radiation opening very efficiently against external mechanical influences.

The sound damper according to the invention is very compact and space-saving and is designed in a mechanically sturdy manner. Since the described components of the sound damper have a multiple function in many cases, the entire sound damper can be manufactured with a few components in a way that is both assembly-friendly and reasonable in price. Also a necessary exchange of individual components, for example in the event of a repair, is made considerably simpler.

BRIEF DESCRIPTION OF THE DRAWINGS

The foregoing objects of the invention, together with other objects and advantages which may be attained by its use, will become more apparent upon reading the following detailed description of the invention taken in conjunction with the drawings. Shown in the drawings, where like reference numerals identify corresponding components, are in:

FIG. 6 to

DETAILED DESCRIPTION OF THE INVENTION

Figure 1:
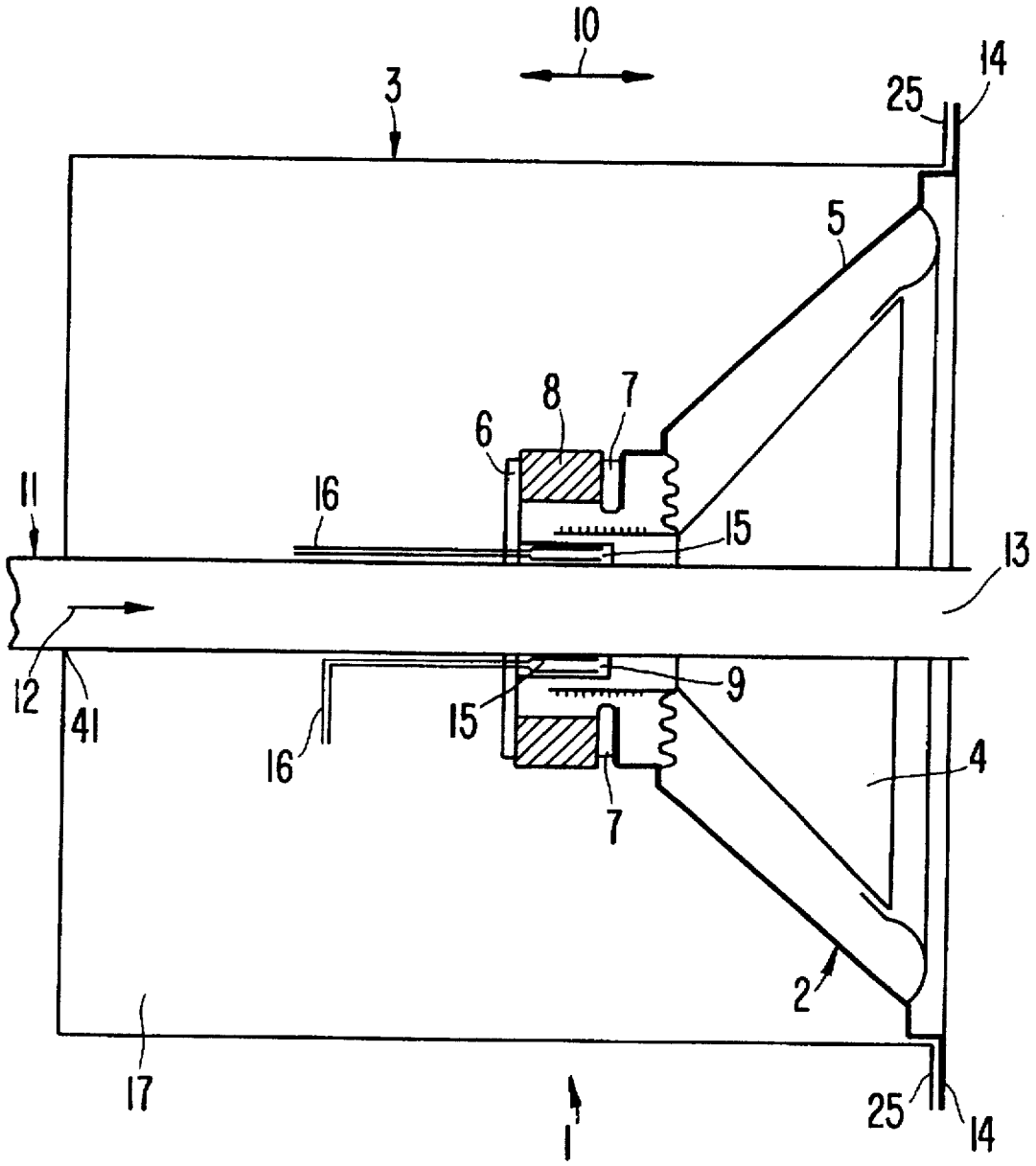
FIG. 1, a lateral view of the sound damper according to the invention, with a speaker in cross section, FIG. 2, the sectional view of a conventional sound damper for exhaust systems in motor vehicles corresponding to the sectional line II—II in FIG. 3, FIG. 3, the sectional view of the conventional sound damper corresponding to the sectional line III—III in FIG. 2, FIG. 4, a sectional view of the sound damper according to the invention in exhaust systems in motor vehicles, corresponding to the sectional line IV—IV in FIG. 5, FIG. 5, the sectional view of the sound damper corresponding to the sectional line V—V in FIG. 4.

In the active sound damper 1 shown in FIG. 1, a speaker 2 is inserted into a closed speaker housing 3. The speaker 2 is embodied as a cone speaker.

A funnel-like, flared speaker cone 4, a speaker frame 5, which surrounds the speaker cone in a funnel-like manner, and a ring magnetic system are the essential components of the speaker 2. The magnetic system has pole plates 6, 7, a ring magnet 8, which is disposed between the pole plates 6, 7, as well as a pole core 9, which is radially surrounded by the ring magnet 8. The structure and operation of the speaker 2 are generally known and are described for example in F. Hausdorf, Handbuch der Lautsprechertechnik (Handbook of Speaker Technology), Vol. 3, 1990, Copyright VISATON, p. 22 et seq.

The pole plate 6 and the pole core 9 are centrally drilled in the axial direction 10 of the speaker 2. A dust protection cap, which is usually aligned to be perpendicular to the axial direction 10, is not provided in the region of the speaker cone 4. In this manner, the speaker 2 can concentrically surround a sound pipe 11. Thus, the pole core 9 rests directly against the pipe jacket of the sound pipe 11. The sound pipe 11 form-fittingly passes through a cutout 41 of the speaker housing 3 and is used to carry interference noise in the sound carrying direction 12. The interference noise is then radiated outward at the pipe opening of the sound pipe 11, which functions as a radiation opening 13. The speaker 2 is aligned relative to the sound pipe 11 in such a way that the radiation opening 13 and a frame edge 14, which defines the funnel opening of the speaker frame 5, are approximately disposed on the same level. As a result, conventionally standard transmission paths between the radiation opening 13 and a speaker are to a large extent prevented.

The frame edge 14 is fastened to an acoustic baffle 25, which constitutes a component of the speaker housing 3, by means of fastening means, not shown.

If sound pipe 11 is to conduct exhaust gases with correspondingly high exhaust gas temperatures are conducted therethrough, the pole core 9—as shown in FIG. 1—can be configured to contain a plurality of cooling bores 15. The bores 15 are shown schematically. The bores 15 are in flow communication with one another, and with cooling lines 16, also shown schematically. As a result, a closed cooling circuit is produced, through which a suitable coolant for cooling the magnetic system flows. The cooling circuit is disposed either completely in the chamber 17 of the speaker housing 3, or disposed such that or the cooling lines 16 are led out of the speaker housing 3 at a suitable location.

Figure 2:
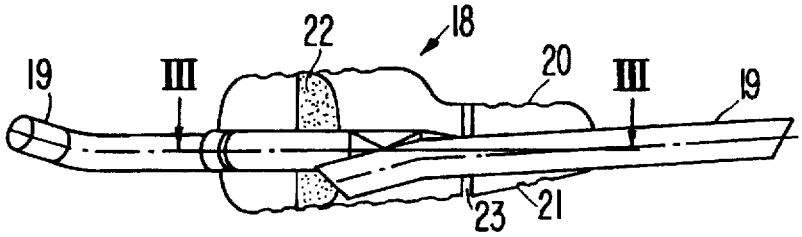
FIG. 2 PRIOR ART
Figure 3:
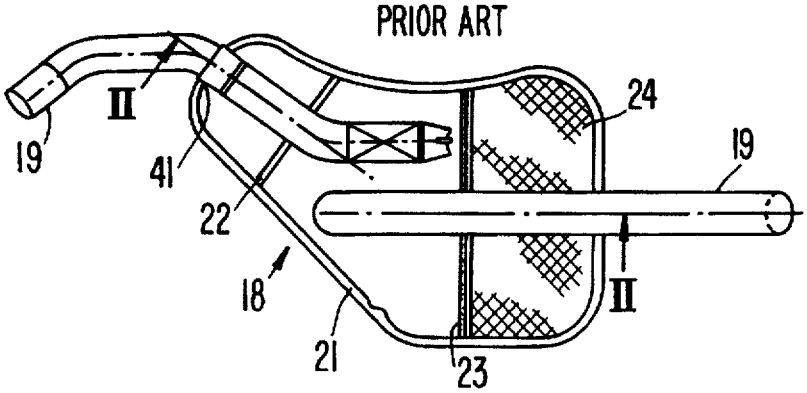
FIG. 3 PRIOR ART

FIGS. 2 and 3 show a conventional sound damper 18 for exhaust pipes 19 in motor vehicles, which is constructed in the semimonocoque design. The outer shape of the sound damper 18 is adapted to the undercarriage of the vehicle. The sound damper 18 is comprised of two half shells 20, 21, which are sealingly connected to each other in an known manner by means of suitable connection techniques, e.g. welding. Support plates 22, 23 are aligned to be approximately perpendicular to the longitudinal axis of the exhaust pipe 19 in the chamber of the sound damper 18 to stabilize the chamber mechanically. Sound absorbing damping material is inserted in the chamber of the sound damper 18 to absorb sound.

Figure 4:
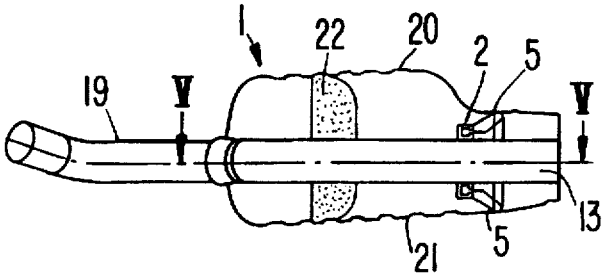
Figure 5:
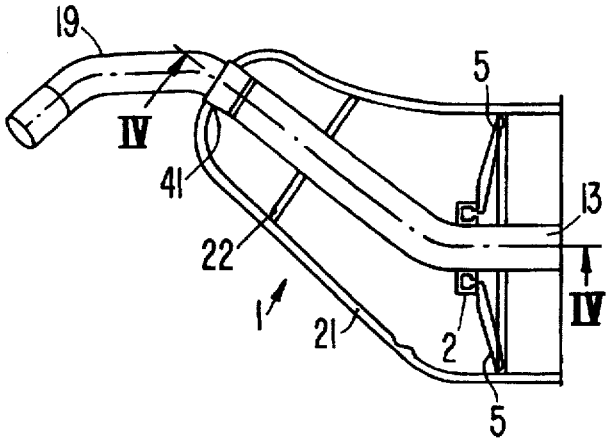

The basic design of the sound damper 1 according to the invention can now be advantageously implemented this kind of conventional sound damper 18. For this purpose, the damping material 24 and the support plate 23 of FIGS. 2 and 3 may be replaced by the speaker shown in FIG. 1, which concentrically surrounds the exhaust pipe. In the above manner, an opening is produced in the half shells 20, 21 for incorporation of the speaker 2 which is effective for radiating compensation sound, as can be seen in FIGS. 4 and 5. In the course of the above, with its very sturdy speaker frame 5, the speaker 2, serving a double function produces on the one hand the required structural support for both shells 20, 21 for mechanically stabilizing the sound damper 18, and effects on the other hand the radiation of compensation sound for damping or canceling out the exhaust noise as noted above thus, the conventional, passive sound damper 18 may be converted into the active sound damper 1 according to the invention in a reasonably priced and technically simple manner. A cooling circuit, not shown in FIGS. 4 and 5, can likewise be provided for cooling the magnetic system of the speaker 2.

Figure 6:
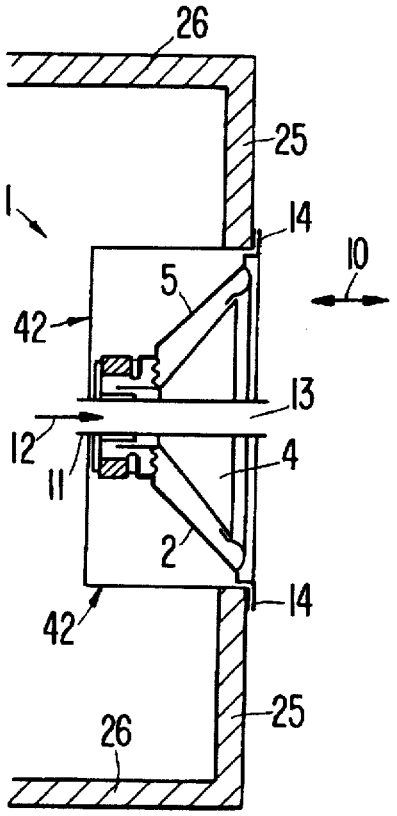

In FIG. 6, the frame edge 14 is fastened to an acoustic baffle 25, which includes a cutout approximately corresponding to the cross section of the frame edge 14 for the insertion of the speaker 2 in the axial direction 10. The sound baffle 25, the frame edge 14, and the radiation opening 13 are disposed approximately in the same plane. A chamber wall 26 respectively adjoins the acoustic baffle 25 on both sides of the speaker 2. The chamber walls 26 are only shown schematically and may be self-contained. The sound baffle 25 and the chamber walls 26 enclose a chamber which may contain interference noise. The chamber may for example be an engine room. A connection to the outside of the chamber permeable to interference noise is produced via ventilation lines or the like. In this case, the sound pipe 11 is the ventilation line, having the radiation opening 13 as the ventilation opening to the outside. The interference noise issuing from a work- or engine room is canceled by means of the above described disposition of the speaker 2. In order to prevent acoustic short circuits, the back of the speaker 2 should be enclosed. A housing-like enclosure 42 is provided for the above purpose.

Figure 7:
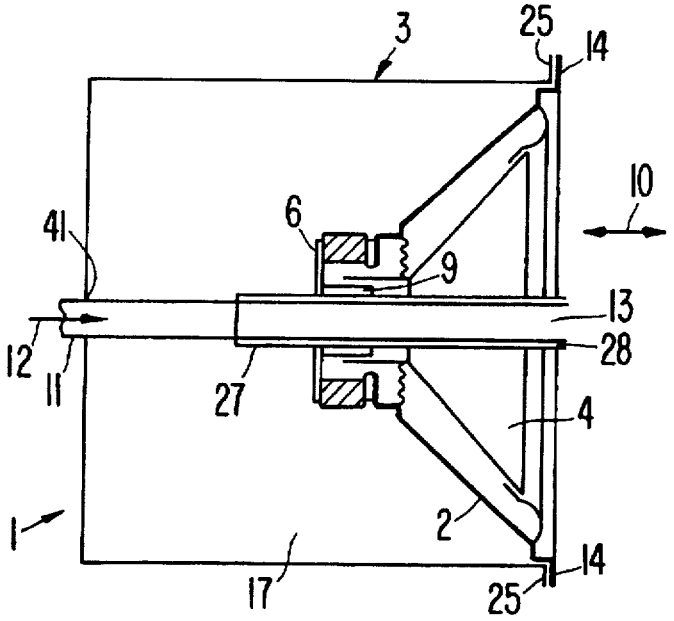

In FIG. 7, the sound pipe 11 is surrounded at a radial distance by an intermediate pipe 27 in the region of the speaker 2. The intermediate pipe 27 extends in the axial direction 10 one end of pipe 27 extends beyond the pole plate 6 the other end of pipe 27 ends at the radiation opening 13. The pole core 9 rests directly against the pipe jacket of the intermediate pipe 27. The intermediate pipe 27 is comprised of a material, suitable for the thermal insulation of the speaker 2 with regard to the sound pipe 11. In addition, when its measurements are correspondingly dimensioned, the intermediate pipe 27 functions in the fashion of a bass reflex tube, and as a result, increases the efficiency of the sound damper 1 in canceling out interference noise.

Figure 8:
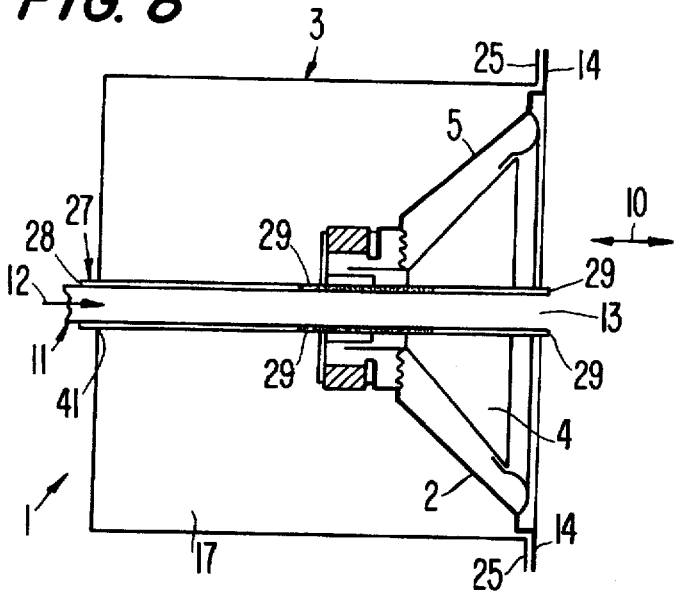

In FIG. 8, the intermediate pipe 27 is disposed such that one of its ends extends outside the speaker housing 3 is opposite the radiation opening 13 in the axial direction 10. In the above case, the pipe conduit 28 formed by the radial distance between the sound pipe 11 and the intermediate pipe 27 is accessible from outside the speaker housing 3. Thus, a suitable coolant, such as air or a fluid for example, can be channeled into the pipe conduit 28 to cool the speaker 2. In addition, the pipe conduit 28 can be used as additional heat insulation between the sound pipe 11 and the speaker 2 by being filled with an insulating layer 29 in the region of the magnetic system of the speaker 2. In the region of the radiation opening 13, the pipe conduit 28 is closed in the axial direction 10 by another insulating layer 29. In another exemplary embodiment, not shown, the entire pipe conduit 28 inside the speaker housing 3 is filled with the insulating layer 29.

Figure 9:
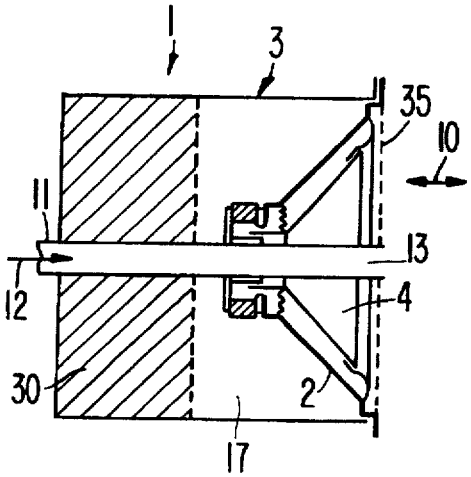

The speaker housing 3 in FIG. 9 is filled with sound absorbing damping material 30 to prevent annoying resonances. In the above case, the damping material 30 covers the back wall of the speaker housing 3, which is disposed opposite the speaker cone 4 in the axial direction 10.

Figure 10:
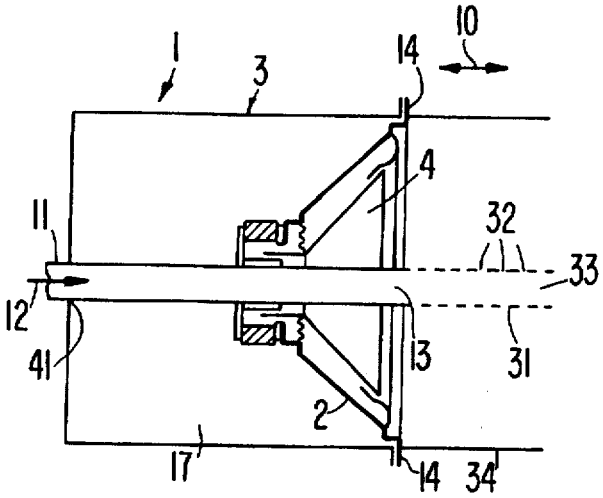

In FIG. 10, the sound pipe 11 is elongated in the sound carrying direction 12 at its radiation opening 13 by means of a front attachment pipe 31. Pipe 31 is manufactured either as a separate element attached to the radiation opening 13, or forms a one piece element together with the sound pipe 11. The interior diameter of the sound pipe 11 and of the front attachment pipe 31 are approximately the same. The pipe jacket of the front attachment pipe 31 contains a multitude of acoustically transparent perforations 32. With the aid of the front attachment pipe 31, exhaust gases flowing through the sound pipe 11 in the sound carrying direction 12 are carried into a region remote from the speaker 2 and can only escape at the pipe opening of the front attachment pipe 31, which functions as the exhaust opening 33. As a result, the speaker 2 and in particular the sensitive speaker cone 4 are better protected from harmful exhaust gases. At the same time, the acoustically transparent perforations 32 assure the required overlapping of the interference noise field and the compensation sound field according to the exemplary embodiments of the sound damper 1 which do not include the front attachment pipe 31.

Furthermore, a concentrating pipe 34 is shown in FIG. 10. It adjoins the frame edge 14 on the front of the speaker cone 4 and extends in the axial direction 10. Viewed in the axial direction 10, the concentrating pipe 34 is flush with the speaker housing 3. The concentrating pipe 34 is either manufactured of one piece with the speaker housing 3 or is fastened as a separate element, for example to the frame edge 14. The concentrating pipe 34 focuses the compensation sound waves radiated by the speaker cone 4. As a result, a concentrated overlap zone is produced in the region in front of the radiation opening 13 between the interference noise field and the compensation sound field. Therefore, a greater percentage of the compensation sound field generated by the speaker 2 is available for canceling out the interference noise. The efficiency of the sound damper 1 is further improved as a result of the above arrangement.

Figure 11:
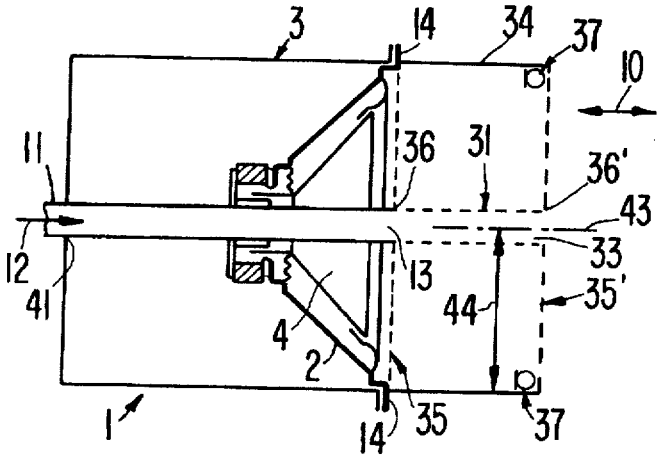

In FIG. 11, the front of the speaker cone 4 is covered in the axial direction 10 by a plate-like, acoustically transparent, perforated protective screen 35. Screen 35 is represented schematically by a dashed line. The protective screen 35 is disposed approximately in the plane of the frame edge 14, and contains a central screen opening 36 for the radiation opening 13. The pipe end of the concentrating pipe 34 opposite the frame edge 14 in the axial direction 10 is connected to another protective screen 35'. Its screen opening 36' radially surrounds the exhaust opening 33 of the front attachment pipe 31. The protective screen 35' concentrating pipe 34 is used not only to protect the speaker 2 from mechanical damage, but also to protect two control sensors attached to the inner wall of the concentrating pipe 34. Each of the two control sensors is a microphone 37 which receives the canceled or damped interference noise and send a corresponding sensor signal to the control unit so that the speaker 2 is triggered depending upon the sensor signal. In other exemplary embodiments, other sensors or only a single sensor can be fastened to the inner wall of the concentrating pipe 34.

In another exemplary embodiment (not shown here), the microphone or microphones 37 are disposed at a radial distance with regard to a pipe axis 43 of the concentrating pipe 34, indicated by a dash-dotted line, which is 0.6 times the pipe radius 44 of the concentrating pipe 34.

Figure 12:
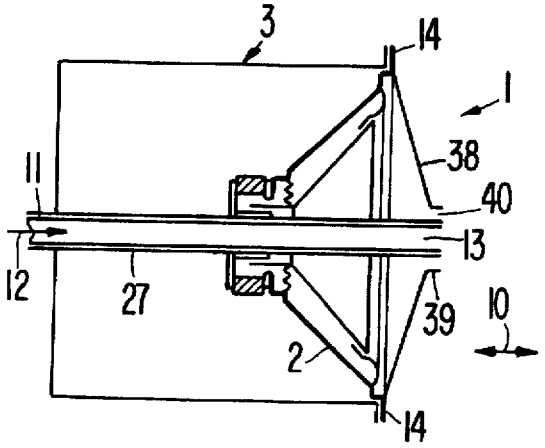

In FIG. 12, the speaker 2 is covered in a hood-like manner on its front in the axial direction 10 by an attachment chamber 38. The attachment chamber 38 is a dynamically balanced component having an imaginary axis of rotation which corresponds with the pipe axis of the sound pipe 11. Attachment chamber 38 is fixed with its edge areas to the frame edge 14 by fastening means, not shown here. Starting from the frame edge the attachment chamber 38 has a cross section which tapers conically in the axial direction 10. The conical tapering terminates in a pipe section 39. The sound pipe 11 is extended in the sound carrying direction 12 beyond the plane of the frame edge 14 approximately to the pipe section 39. The latter defines a chamber opening 40 and surrounds the sound pipe 11 at a radial distance therefrom.

Figure 13:
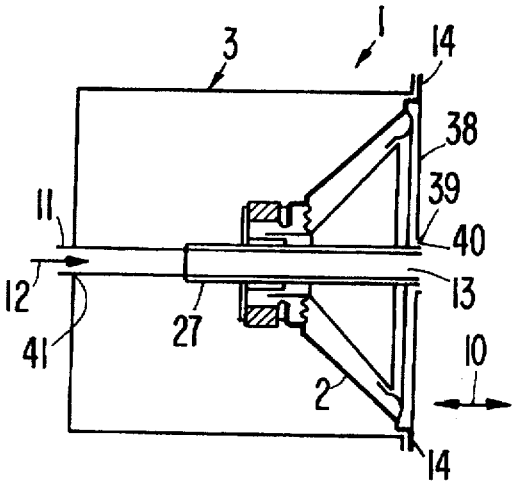
FIG. 13, the side view of the sound damper according to the invention in other embodiments.

FIG. 13 shows a further exemplary embodiment of the attachment chamber 38. In the shown embodiment, attachment chamber 38 is configured as a plate thereby defining a plane which adjoins the plane of the frame edge 14 in a plane parallel manner. The plate-like attachment chamber 38 is bored at a center region thereof. The bore serves as a chamber opening 40. A pipe section 39 projects past the attachment chamber 38 in the axial direction 10. The pipe section 39 surrounds the sound pipe 11 and defines the chamber opening similar to the exemplary embodiment of the sound damper 1 according to FIG. 12.

The attachment chamber 38 and the pipe section 39 described above with respect to FIGS. 12 and 13 function in the fashion of a pressure chamber and as a result, transform the compensation sound radiated by the speaker 2 before it is overlayed with the interference noise in the region of the radiation opening 13. By means of the above transformation, the speaker cone 4 is better adapted to the air. The efficiency of the sound damper 1 is further improved.

The components shown and described in different embodiments of the sound damper 1 can naturally also be integrated into exemplary embodiments in which these components are not shown or described. Thus for example, the cooling circuit with the cooling lines 16 and bores 15, which is explained by means of FIG. 1, is also suitable for the sound damper 1 according to the exemplary embodiments of FIGS. 4 to 13. In this sense, for example the concentrating pipe 34 according to FIGS. 10 and 11 can naturally also be combined with the sound damper 1 according to the exemplary embodiments of FIGS. 1 to 9.

I claim:

1. An active sound damper for compensating interference noise radiated by an interference noise source through a radiation opening thereof, the radiation opening of the interference noise source defining a radiation plane and having a center, the sound damper comprising a speaker for radiating compensation sound for reciprocally effecting one of a weakening and a cancelling of the interference noise by interfering with the interference noise, the speaker having a speaker cone and defining a longitudinal axis, the speaker further being adapted to be mounted on the radiation opening such that its longitudinal axis is disposed to transversely intersect the radiation plane at the center of the radiation opening and such that the speaker cone radially surrounds the radiation opening.

2. The sound damper according to claim 1, wherein the speaker is an electrodynamic speaker.

3. The sound damper according to claim 1, wherein the speaker cone has a frame edge disposed approximately in the radiation plane.

4. The sound damper according to claim 1, wherein the interference noise source includes a noise carrying sound pipe, the radiation opening constituting a pipe opening of the sound pipe.

5. The sound damper according to claim 4, wherein the noise carrying sound pipe is an exhaust pipe.

6. The sound damper according to claim 4, wherein the speaker is an electrodynamic speaker including a magnetic system which comprises a ring magnet, a pole plate disposed at a pole of the ring magnet, and a pole core disposed at a core region of the magnet, the magnetic system radially surrounding the sound pipe, and the pole plate and the pole core further being drilled along a longitudinal axis of the speaker.

7. The sound damper according to claim 4, wherein the speaker surrounds the sound pipe at a radial distance therefrom for forming an intermediate space therebetween, the intermediate space being closed.

8. The sound damper according to claim 7, further comprising a heat insulating layer for closing the intermediate space by being disposed therein.

9. The sound damper according to claim 6, further comprising an intermediate pipe interposed between the speaker and the sound pipe, an outer wall of the intermediate pipe being disposed at a radial distance from the sound pipe thereby forming .an intermediate conduit therebetween.

10. The sound damper according to claim 9, further comprising a heat insulating layer disposed in an axial direction in the intermediate conduit at least in a region of the magnetic system.

11. The sound damper according to claim 9, further comprising a coolant flowing through the intermediate conduit for cooling the speaker.

12. The sound damper according to claim 10, wherein the intermediate conduit is closed to axial flow therethrough at a region of the radiation opening.

13. The sound damper according to claim 12, further comprising a heat insulating layer for closing the intermediate conduit at the region of the radiation opening.

14. The sound damper according to claim 9, wherein the intermediate pipe is a bass reflex tube having a bass reflex opening surrounding the radiation opening.

15. The sound damper according to claim 6, wherein the pole core of the magnetic system includes at least one bore therein for providing a cooling conduit for coolant to flow therethrough.

16. The sound damper according to claim 6, wherein the at least one bore includes a plurality of bores disposed along a circumference of the pole core and in fluid communication with one another.

17. The sound damper according to claim 1, further comprising:

an acoustic baffle; and a speaker frame surrounded by the acoustic baffle and having a frame edge fastened thereto, the speaker frame further being effective for centering the speaker cone with respect to the acoustic baffle.

18. The sound damper according to claim 17, wherein the speaker further comprises a closed speaker housing defining an opening therein for passage of the radiation opening therethrough, the acoustic baffle constituting a component of the closed speaker housing.

19. The sound damper according to claim 18, further comprising a sound damper housing, wherein:

the sound pipe is an exhaust pipe of an internal combustion engine; and the speaker housing corresponds to the sound damper housing.

20. The sound damper according to claim 19, wherein:

the sound pipe is an exhaust pipe of an internal combustion engine of a motor vehicle; and the sound damper housing is adapted to be mounted on motor vehicles.

21. The sound damper according to claim 18, further comprising sound absorbing damping material at least partially filling the speaker housing.

22. The sound damper according to claim 1, further comprising an acoustically transparent front attachment pipe including a perforated pipe jacket and adjoining the radiation opening, wherein the radiation opening constitutes a pipe opening of an exhaust pipe, the front attachment pipe extending the exhaust pipe in a sound carrying direction.

23. The sound damper according to claim 17, further comprising an acoustically transparent, perforated protective screen fastened to the frame edge of the speaker frame for covering a front region of the speaker cone, the screen including a central screen opening therein which radially surrounds the radiation opening.

24. The sound damper according to claim 23, wherein the protective screen is plate-shaped.

25. The sound damper according to claim 17, further comprising a concentrating pipe for concentrating the interference noise and the compensation sound thereby producing compensated interference noise, the concentrating pipe adjoining a front region of the speaker cone at the frame edge of the speaker frame and having a longitudinal axis disposed to transversely intersect the radiation plane at the center of the radiation opening.

26. The sound damper according to claim 25, further comprising an acoustically transparent front attachment pipe including a perforated pipe jacket and adjoining the radiation opening, wherein the radiation opening constitutes a pipe opening of an exhaust pipe, the front attachment pipe extending the exhaust pipe in a sound carrying direction, the concentrating pipe and the front attachment pipe further ending approximately flush with one another in a sound carrying direction.

27. The sound damper according to claim 26, wherein the concentrating pipe includes a locking collar thereon adapted to be fastened at the front region of the speaker cone to the frame edge of the speaker frame for covering the front region of the speaker cone, the sound damper further comprising an acoustically transparent, perforated protective screen fastened to the locking collar of the concentrating pipe.

28. The sound damper according to claim 25, further comprising at least one sensor disposed inside the concentrating pipe for receiving the compensated interference noise.

29. The sound damper according to claim 28, wherein the sensor is disposed at a radial distance with respect to a pipe axis of the concentrating pipe, the sensor further extending in a direction defined by the pipe axis.

30. The sound damper according to claim 29, wherein the radial distance with respect to the pipe axis is about 0.6 times a distance between the pipe axis and an inner wall of the concentrating pipe.

31. The sound damper according to claim 30, wherein the sensor is a microphone.

32. The sound damper according to claim 17, further comprising a sound impermeable and dynamically balanced attachment chamber fastened to the frame edge, the attachment chamber covering a front region of the speaker cone in a hood-like fashion and defining a central chamber opening therein which surrounds the radiation opening at a radial distance therefrom.

33. The sound damper according to claim 32, further comprising a pipe section fastened to a front wall of the attachment chamber at the central chamber opening.

* * * * *